United States Patent [19]

Lagasse et al.

[11] Patent Number: 4,888,748

[45] Date of Patent: Dec. 19, 1989

[54] GENERAL PURPOSE DUAL MODE CLOCK AND TIMER UNIT

[76] Inventors: Lyle E. Lagasse, P.O. Box 7636, Colorado Springs, Colo. 80933; Dennis D. Andrews, 424 Edgewood Dr., Colorado Springs, Colo. 80907

[21] Appl. No.: 272,638

[22] Filed: Nov. 17, 1988

[51] Int. Cl.[4] ..... G04F 8/00; G04B 19/00

[52] U.S. Cl. ..... 368/107; 368/223; 368/276

[58] Field of Search ..... 368/76, 80, 88, 107–113, 368/220, 223–228, 276, 314–317

[56] References Cited

U.S. PATENT DOCUMENTS

| | | | |
|---|---|---|---|
| Re. 30,987 | 3/1979 | Jones | 368/76 |
| D. 229,076 | 11/1973 | Kurtenbach et al. | D34/5 MM |
| 3,106,817 | 10/1963 | Ducommun | 58/2 |
| 3,184,911 | 5/1965 | Canale et al. | 58/44 |
| 3,961,473 | 6/1976 | Hung | 58/145 D |
| 4,110,966 | 9/1978 | Kashio | 58/4 A |
| 4,188,779 | 2/1980 | Fatton | 58/153 |
| 4,424,967 | 1/1984 | Yokoi et al. | 273/1 GC |
| 4,472,067 | 9/1984 | Richardson et al. | 368/96 |
| 4,720,820 | 1/1988 | Siefert | 368/76 |

OTHER PUBLICATIONS

Timco Clock Model AC-8, Timco Engineering Inc., one page.

Franklin Stop Clock Count-Up Timer Model Inst-2, Franklin Clock Company, one page.

Meylan Dual Timer Model #6204 & Meylan Interval Seconds Timer No. 23, Meylan Corporation, 3 pages.

Accusplit/Cronus Gaalab Electric Game Timer Models G165A & G165S and CGOO Series, 3 pages.

West Bend Digital Clock/Timer, Sporty's Preferred Lining Catalog, two pages.

*Primary Examiner*—Vit W. Miska

*Attorney, Agent, or Firm*—John R. Flanagan

[57] ABSTRACT

A dual mode clock and timer unit includes a housing and a plurality of displays mounted on the housing for facilitating the viewing of time-related data from different directions. The housing has top, bottom, and side surfaces defining the exterior of the housing in a generally truncated pyramidal shape. The displays are mounted on the housing side surfaces and angularly displaced from one another. Switches are mounted on the top and bottom housing surfaces and are actuable for selecting one or the other of dual clock and timer operating modes and, after one or the other of the dual modes have been selected, for causing different functions to occur in one of the modes than in the other of the modes. Also, a circuit, such as microcomputer-based circuit, is provided in the housing electrically connected between the switches and each of the displays for currently carrying out operations in clock and timer modes and for causing indications of time-related data on the displays relating to one or the other, but not both concurrently, of clock and timer modes in response to selected actuation of the switches.

30 Claims, 3 Drawing Sheets

GENERAL PURPOSE DUAL MODE CLOCK AND TIMER UNIT

BACKGROUND OF THE INVENTION

1. Field of the Invention

The present invention generally relates to timing devices and, more particularly, is concerned with a general purpose dual mode clock and timer unit.

2. Description of the prior Art

A wide variety of timing devices are known in the prior art. Representative of the prior art are the timing devices disclosed in U.S. Pat. Nos. to Kurtenbach et al (Des. 229,076), Ducommun (3,106,817), Canale et al (3,184,911), Hung (3,961,473), Kashio (4,110,966), Jones (Re. 30,987; 4,144,708), Fatton (4,188,779), Yokoi et al (4,424,967) and Richardson et al (4,472,067).

Many of timing devices of the prior art probably operate reasonably well and generally achieve their objectives under the range of operating conditions for which they were designed. However, most seem to embody certain shortcomings which make them less than an optimum timing device. Some are designed for general purpose use and multiple person or user viewing but are extremely limited in the number and kinds of functions they can perform. Others are designed for multiple person or user viewing but special purpose use and so limit their capability to performing multiple functions for that special purpose or event. Still others are designed for general purpose use and multi-function operation but really can be viewed by only a single person or user.

In view of the aforementioned shortcomings, it has been perceived by the inventors herein that a need remains for a timing device which is more versatile and universal than has been devised heretofore.

SUMMARY OF THE INVENTION

The present invention provides a dual mode clock and timer unit designed to overcome the above-cited shortcomings and to satisfy the aforementioned needs. Advantageously, the dual mode unit of the present invention is both special purpose and general purpose in its applications. Although, the dual mode unit is primarily intended for special purpose use as a game timer, it is equally capable of use as a general purpose timer and a general purpose clock.

The dual mode unit provides an arrangement of multiple displays which facilitates the viewing of time-related data from different directions by many persons at the same time. Also, the dual mode unit employs a large number of different functions which enhances its general utility as both a clock and timer.

Further, the dual mode unit is exceedingly user friendly. The current status of the dual mode unit is clearly identified by lighted symbols. Further, the switches on the unit for selecting different functions are clearly identified by indicia printed on the unit adjacent the switches. Enough information is presented directly on the unit itself so that the user should not have to refer constantly to operating instructions in order to use the unit.

Accordingly, the present invention is directed to a dual mode clock and timer unit which comprises: (a) a housing having a top surface, a bottom surface and a plurality of side surfaces located between the top and bottom surfaces, all of the surfaces together defining the exterior of the housing in a generally truncated pyramidal shape; (b) a plurality of displays, each display mounted on one of the side surfaces of the housing for facilitating the viewing of time-related data at different directions therefrom; (c) a plurality of switches mounted on top and bottom surfaces of the housing, at least one of the switches being actuatable for selecting one or the other of clock an timer operating modes, at least some of the switches being actuatable, after one or the other of the dual modes have been selected, for causing different functions to occur in one of said modes than in the other of the modes; and (d) circuit means mounted on the housing and electrically interconnected between the switches and each of the displays for concurrently carrying out operations in clock and timer modes and for causing indication of time-related data on the displays relating to one or the other, but not both concurrently, of clock and timer modes in response to selected actuation of the switches.

More particularly, when the housing is placed in an upright position, its top and bottom surfaces are oriented generally horizontally and are vertically spaced from one another. The side surfaces of the housing are interconnected to one another and angularly displaced from one another. The top surface has the same geometric shape as the bottom surface but is smaller in area than the bottom surface. The side surfaces each have substantially the same geometric shape and the same area.

Further, in one embodiment, each of the side surfaces has a portion mounting one of the displays in an inclined orientation. In the other embodiment, each of the side surfaces has a recessed portion mounting one of the displays in a vertical orientation.

Still further, one of the switches is actuatable to a first postion for causing the circuit means to count upward from zero when the timer operating mode has been selected. The one switch is also actuatable to a second position for causing the circuit means to count downward toward zero when the timer operating mode has been selected. In either position of the one switch, preferably the circuit means continues to count upward or downward after reaching the desired count.

Preferably, the unit also includes a warning alarm which is preset to "sound" various numbers of times before, at, and after a desired time (or count) is reached. First, the alarm is preset to sound a first predetermined number of times at a user programmed period of time before the desired time is reached to alert the user that the desired time is close. Next, the alarm is preset to sound a second predetermined number of times when the desired time is reached to alert the user of the arrival of the desired time. Then, the alarm is preset to recurringly sound the second predetermined number of times at lapse of preset time intervals after the desired time to periodically alert the user that the time is beyond the desired time. Preferably, the second predetermined number of times the alarm sounds is greater than the first predetermined number of times. Further, the warning alarm can be selected to "sound" as either a visual signal solely, as an audible signal solely, or as visual and audible signals concurrently.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
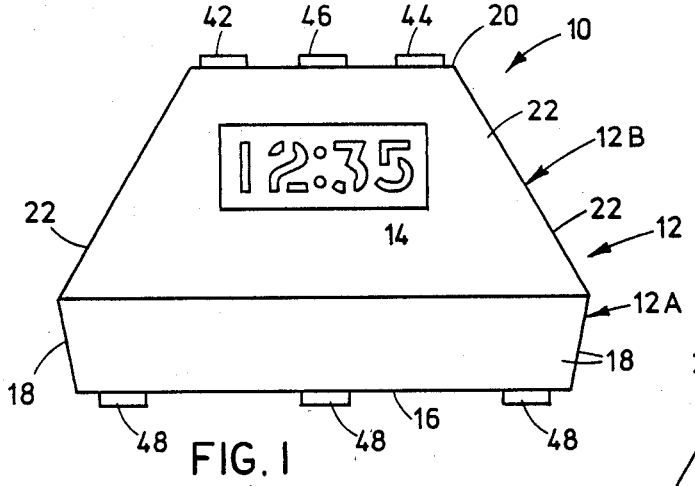
FIG. 1 is a side elevational view of one embodiment of the dual mode clock and timer unit of the present invention.

Referring now to the drawings, and particularly to FIGS. 1–3 and 5, there is shown one embodiment of the clock and timer unit, generally designated by the numeral 10, which is constructed in accordance with the principles of the present invention. The clock and timer unit 10 is both a special and general purpose, multi-display, multi-function, and multi-user device and can be characterized as dual mode in the sense that it can alternately function as a clock or a timer. The unit 10 is primarily intended for special purpose use as a game timer; however, it is equally capable of use as a general purpose timer or clock.

Figure 2:
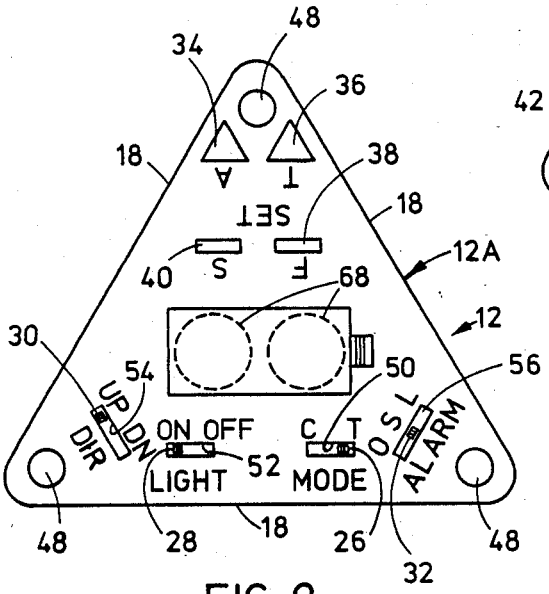
FIG. 2 is a bottom plan view of the dual mode unit FIG. 1.
Figure 3:
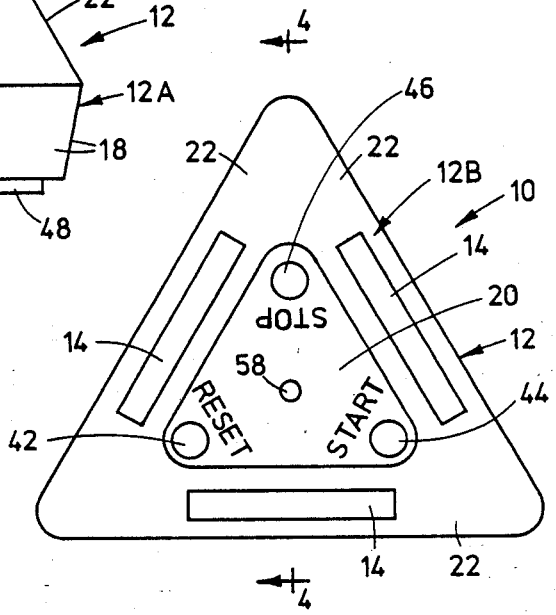
FIG. 3 is a top plan view of the dual mode unit of FIG. 1.
Figure 4:
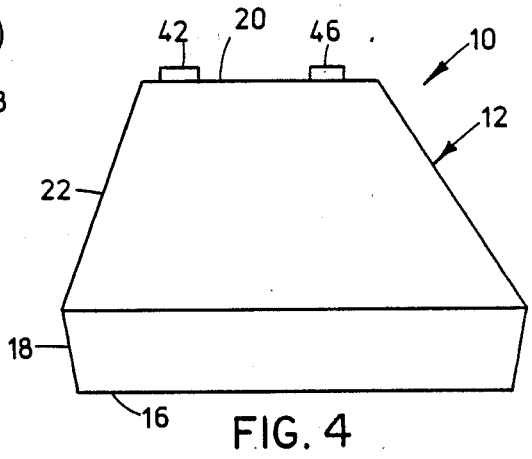
FIG. 4 is a sectional view of the dual mode unit taken 4—4 of FIG. 3 to illustrate a side profile of the unit.

As seen in FIGS. 1–3, the dual mode clock and timer unit 10 includes a housing 12 and a plurality of displays 14. The housing 12 of the unit 10 can be composed of any suitable material, for instance plastic or wood. Basically, the housing 12 has a lower skirt portion 12A and an upper display support portion 12B. Preferably, the exterior of the lower skirt portion 12A of the housing 12 is defined by a generally horizontal triangular-shaped planar bottom surface 16 and a plurality of side surfaces 18 interconnected at their opposite side edges with one another and at their lower edges with the bottom surface 16. Each of the side surfaces 18 of the housing lower skirt portion 12A are of much greater length than height.

Preferably, the exterior of the upper display support portion 12B of the housing 12 is defined by a triangular-shaped planar top surface 20 and a plurality of side surfaces 22. The inclined side surfaces 22 are generally located between the bottom and top surfaces 16, 20. Specifically, each of the side surfaces 22 has a generally inclined trapezoidal-shaped planar configuration and is interconnected by rounded edges or corners with the other side surfaces, at its upper edge with the top surface 20 and at its bottom edge with the top edges of the side surfaces 18 of the housing lower skirt portion 12A. The side surfaces 18 of the lower skirt portion 12A are inclined inwardly in the opposite direction to the inclination of the side surfaces 22 of the upper display support portion 12B.

Preferably, the top surface 20 thus has the same geometric shape as the bottom surface 16 but is smaller in area than the bottom surface. The inclined side surfaces 22 have substantially the same geometric shape and cover the same area. Also, preferably, there are three side surfaces 18 and three side surfaces 22 which provide the housing 12 in plan view with an overall triangular configuration. However, it should be understood that the side surfaces 18, 22 can be greater in number than three. All of the surfaces 16–22 cooperate together to provide the exterior of the housing 12 of the unit 10 with a generally triangular truncated pyramidal shape.

Each display 14 of the unit 10 is mounted on one of the inclined side surfaces 22 of the upper support portion 12B of the housing 12. In the embodiment illustrated in FIGS. 1 and 2, the three side surfaces 22 are angularly displaced approximately 120 degrees from one another and support the displays 14 in the same angular relationship. The triangular truncated pyramidal shape of the housing side walls 22 permits essentially 360 degree viewing of the displays 14 supported thereon from different directions by multiple users simultaneously. As will be explained below, the time-related data indicated on one of the displays 14 is identical with that on the others. Preferably, the displays 14 are conventional electronic LED or LCD type displays although other types could be used.

Further, as best seen in FIGS. 2 and 3, the unit 10 includes a first group of switches 26–40 for switching the unit 10 between its dual operating modes and for presetting other conditions of operation in both of the modes. The first group of switches 26–40 are mounted on and accessible at the bottom surface 16 of the housing 12 by picking up the unit 10 and turning it over. The unit 10 further includes a second group of switches 4246 for initiating different functions in each of the dual clock and timer modes of the unit. The second group of switches 42–46 are mounted on and accessible at the top surface 20 of the housing 12 without moving the unit 10 from its normal position standing on a plurality of pedestals 48 attached at the corners of the housing bottom surface 16.

Turning first to FIG. 2, four of the eight switches on the bottom surface 16 are preferably in the form of slide switches 26–32 and the other four switches are in the form of holddown switches 34–40. The slide switches 26–32 must be moved laterally right and left in elongated slots 50–56 in the bottom surface 16 to select different functions or preset conditions, whereas the holddown switches 34–40 must be depressed to initate different functions.

More particularly, as shown in FIG. 2, a first slide switch 26 on the bottom surface 16 of the housing 12 is slidably movable along the slot 50 between a pair of displaced positions, C and T, for selectively switching the unit 10 between clock and timer operating modes. A second slide switch 28 is slidably movable along the slot 52 between a pair of displaced positions, "off" or "on", for correspondingly controlling a visual alarm 58 (FIG. 5), such as an incandescent lamp or a light-emitting diode (LED). The second slide switch 28 functions the same in both timer and clock operating modes of the unit 10.

A third slide switch 30 on the bottom surface 16 of the housing 12 is slidably movable along the slot 54 between a pair of displaced positions, "up" and "down", for selectively presetting the unit 10 when in its timer mode to count upward from zero or downward toward zero. For example, the countup capability of the unit 10 might be to any user-selected interval from one second to ninety-nine minutes and fifty-nine seconds. The countdown to zero capability of the unit 10 might be just the opposite. Preferably, in either position of the third slide switch 30, the count continues upward or downward after reaching the desired count. The third slide switch 30 is used to reset the clock if there is a time overrun in setting the unit 10 in either operating mode.

A fourth slide switch 32 on the bottom surface 16 of the housing 12 is slidably movable along the slot 56 between three displaced positions, "0", "S" and "L", for selectively presetting an audible alarm or buzzer 60 (FIG. 5), such as a piezoelectric buzzer, at either "off", "soft" or "loud" conditions. Thus, the fourth slide switch 32 controls the volume of the audible alarm 60. The fourth slide switch 32 functions the same in both timer and clock operation modes of the unit 10.

A first holddown switch 34 on the bottom surface 16 of the housing 12, identified in FIG. 2 by "A", is an alarm setting switch. In the timer mode of the unit 10, by depressing the first holddown switch 34, the unit 10 is placed in an early warning alarm set mode, in which the user selects the time interval for the early warning alarm to go off. Thus, the early warning alarm is user programmable to be set at any time interval before an actual time-out has occurred. On the other hand, in the clock mode of the unit 10, depressing the first holddown switch 34 allows the alarm time to be set.

Preferably, in both the clock and timer modes of the unit 10, the alarm (which can be either visual alarm 58 or audible alarm 60 or both) is preset to "sound" in several different ways depending on the relationship of the current time (or count) to the desired time (or count) of the unit. In other words, the alarm will sound various numbers of times before, at, and after a desired time is reached. For instance, first, the alarm is preset to sound a first predetermined number of times, for example two, at a user programmed period of time, for example fifteen seconds, before the desired time is reached to alert the user that the desired time is close. Next, the alarm is preset to sound a second predetermined number of times, for example ten, when the desired time is reached to alert the user of the arrival of the desired time. Then, the alarm is preset to recurringly sound (until the alarm is turned off) the second predetermined number of times at lapse of preset time intervals, for example one minute, after the desired time to periodically alert the user that the current time is beyond the desired time. As exemplified by the examples selected above, preferably, the second predetermined number of times the alarm sounds is greater than the first predetermined number of times.

A second holddown switch 36 on the bottom surface 16 of the housing 12, identified in FIG. 2 by "T", is a time setting switch. In the timer mode of the unit 10, by depressing the second holddown switch 36, the unit 10 is placed in a mode where the countup to or countdown from desired time can be set using third slide switch 30. When the desired time value is set to zero, and the up/down slide switch 30 is set to "up", the unit 10 functions in the timer mode as a free running timer (i.e., a stopwatch) and continues to count up until one of the three other switches 42–46 on the top surface 20 of the housing 12, which are described below, are depressed or until the time reaches a maximum, such as ninety-nine minutes and fifty-nine seconds. The function of the second holddown switch 36 in the clock operating mode of the unit 10 is to set the current clock time of the unit. In the timer mode, the unit 10 retains its previously set timer parameters such as count up/down, count time and early warning alarm time until reprogrammed by the user.

Third and fourth holddown switches 38, 40 on the bottom surface 16 of the housing 12 are identified in FIG. 2 by "F" and "S". These switches are depressed to alter or change at respective fast and slow rates the current time, or the alarm time, of the unit 10 when in the clock operating mode and its early warning time interval, countup time and countdown time when in the timer mode.

Referring next to FIG. 3, the three other switches 42–46 on the top surface 20 of the housing 12 are preferably in the form of momentary pushbutton switches. Respectively, the pushbutton switches 42–46 are identified by the captions "reset", "start" and "stop" in FIG. 3. When the unit 10 is in the timer operating mode, depressing the reset pushbutton switch 42 on the top surface 20 of the housing 12 returns the unit 10 to a preset countdown time value or to zero depending upon which position, "up" or "down", the third slide switch 30 on the bottom surface 16 of the housing 12 has been preset in. If the reset switch 42 is depressed when either the unit 10 is running in the timer mode or has been stopped in the timer mode, then the unit 10 returns to the preset timer value and stops. When the unit 10 is in the clock operating mode, depressing the reset switch 42 causes the current month and date to be displayed while depressed.

When the unit 10 is in the timer mode at the preset timer value, depressing the start pushbutton switch 44 on the top surface 20 of the housing 12 starts the unit 10 in a countup or countdown sequence depending upon which position, "up" or "down", the third slide switch 30 on the bottom surface 16 of the housing 12 has been preset in. If the start switch 44 is depressed when the unit 10 is running in the timer mode, then the unit 10 returns to the preset timer value and starts counting again. If the start switch 44 is depressed when the unit 10 has been stopped in the timer mode, then the unit 10 continues counting from the current timer value. The start pushbutton switch 44 has no function in the clock operating mode of the unit 10.

When the unit 10 is in the timer mode and the unit is running, depressing the stop pushbutton switch 46 on the top surface 20 of the housing 12 stops the unit 10 from continuing to count and holds the current timer value. If the unit 10 in the timer mode has timed out at its maximum count (for instance, plus or minus ninety-nine minutes and fifty-nine seconds) or has been stopped, then depressing the stop switch 46 has no effect. Depressing the stop switch 46 in the clock mode of the unit 10 has the effect of terminating the audible and/or visual alarm.

Figure 5:
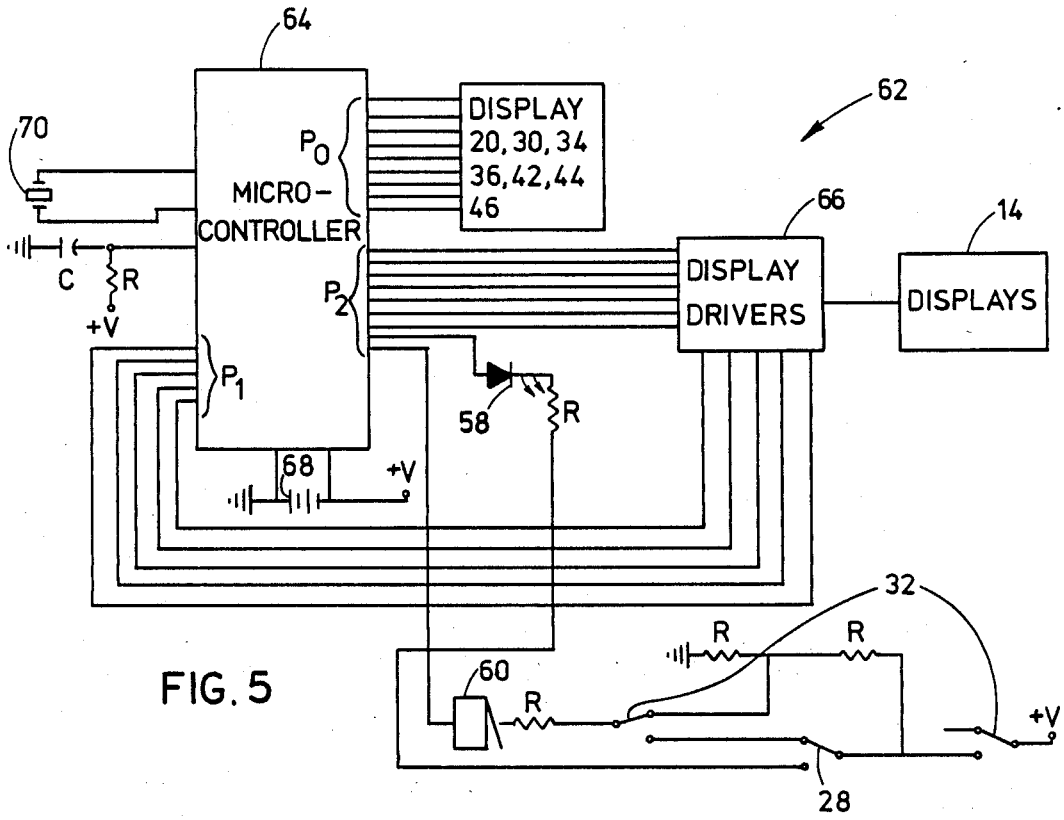
FIG. 5 is a block diagram representation of a circuit performing the multiple functions of the dual mode unit of FIG. 1.
Figure 6:
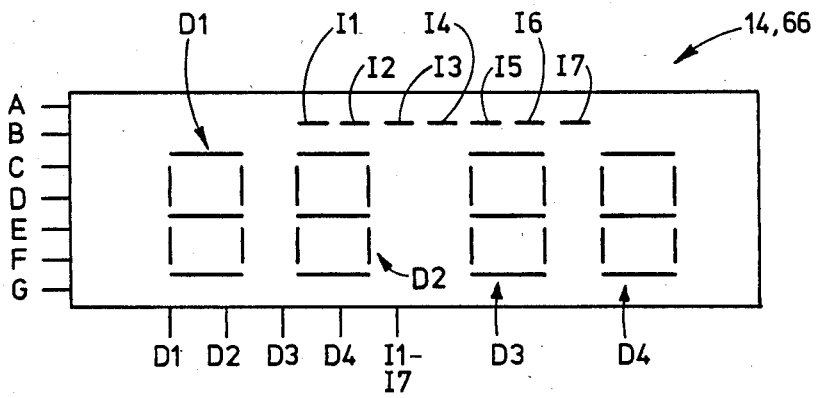
FIG. 6 is a view of one of the displays of the circuit provided in the dual mode unit of FIG. 1.

Finally, the dual mode unit 10 includes circuit means, generally designated 62 and shown in block diagram form in FIGS. 5 and 6. The circuit means 62 is preferably implemented on one or more integrated circuit chips mounted in the housing 12 and electrically connected between the above-described first and second groups of switches 26–46 and each of the displays 14 for concurrently carrying out operations in clock and timer operating modes and for causing indication of timerelated data on the displays relating to one or the other, but not both concurrently, of clock and timer modes in response to selected actuation of the switches. FIG. 5 depicts only one implementation of the circuit means 62 to perform the functions described above with respect to the switches 26–46.

In the exemplary implementation illustrated in FIG. 5, in addition to the displays 14, switches 26–46, and visual and audible alarms 58, 60, the circuit means 62 incorporates a microcontroller 64, display drivers 66, a battery 68 and an external oscillator 70. The microcontroller 64 can be any one of many commercially available single-chip microcomputers. As is well known, the microcontroller 64 includes a central processing unit, read only memory, random access memory, input and output ports, clock oscillator circuitry, event counters and timer registers. Only the input and output ports $P_0$, $P_1$ and $P_2$ of the microcontroller 64 can be seen and are identified in FIG. 5. To make battery operation feasible, the microcontroller should be of complementary metal-oxide semiconductor construction.

The input ports $P_0$ of the microcontroller 64 are electrically connected to the switches 26, 30, 34 and 36 on the bottom surface 16 of the housing 12 and switches 42, 44 and 46 on the top surface 20 of the housing. Only one tandemly connected pair of display 14 and display driver 66 is shown in FIG. 5 and is depicted in combined form in FIG. 6; however, it should be understood that in the illustrated three-sided embodiment of the unit 10, there are three of such pairs. In embodiments of the unit 10 having four, five or more sides, a corresponding number of pairs of display 14 and display driver 66 would be provided.

As seen in FIGS. 5 and 6, a first group of inputs A–G of the display driver 66 is electrically connected in parallel to most of one group of output ports $P_2$ of the microcontroller 64 for powering digit and indicator segments D1–D4 and I1–I7 of the displays 14. In FIG. 6, the indicator segments I1–I7 are shown as a series of spaced bars; however, it should be understood that they can take other forms, such as a series of visual symbols readily be interpretable by users to signify the particular functions or status conditions of the unit 10.

Another group of output ports $P_1$ of the microcontroller 64 are connected electrically in parallel to each of a second group of inputs D1–D4 and I1–I7 of the display drivers 66 for enabling and disabling the corresponding display digits D1–D4 and indicator segments I1–I7 of the displays 14. The alarms 58, 60 are connected respectively in series between a final pair of the output ports $P_2$ of the microcontroller 64 and the final two switches 28, 32 on the bottom surface 16 of the housing 12.

To operate the unit 10 and display time-related data in its timer and clock modes, a suitable digital software code or program is stored into the read only memory (ROM) of the microcontroller 64. The description provided earlier of the different functions initiated by actuation of the various switches 26–46 is believed to be in sufficient detail to guide a person of ordinary skill in microcontroller programming, without undue experimentation and within a relatively short period of time, to write a program to operate the microcontroller 64 in the dual modes.

Upon power-up, the program stored in the ROM initializes the various input and output ports, and stores the necessary values in the random access memory (RAM) of the microcontroller 64. The frequency of the on-chip oscillator circuitry is determined by the external crystal or oscillator 70. This highly stable frequency is divided by the on-chip timer registers and used to generate interrupts to the central processing unit (CPU) of the microcontroller 64. Programs coded in the interrupt service routines modify the contents of the internal registers to reflect the passage of time. Other components of the program read the positions of the switches, as reflected at the one group of inputs of the microcontroller 64, and modify functions of the unit 10 accordingly.

Periodically, the program in the ROM directs proper information to the displays 14 through the output ports of the microcontroller 64. The program interprets information stored in the RAM to enable the proper display segments and digits. Each digit is enabled in sequence at the same time the proper segment information is presented. Indicator segments I1–I7 are treated as a fifth digit by the display driver circuitry 66.

As mentioned above with reference to FIG. 6, each display 14 includes four seven-segment digits D1–D4 and up to seven additional indicator segments I1–I7 to alert users of the current status of the unit 10 in its clock and timer modes Any commercial display technology could be used with the proper choice of driver circuitry and battery.

As function, switch position, and time count dictates, the microcontroller 64 also enables the visual alarm 58 or the audible alarm 60. The visible alarm 58 can be an incandescent lamp or a light-emitting diode. The audible alarm 60 can be a piezo-electric buzzer with the loud/soft switch 32 functioning as a voltage divider through associated resistors. The audible alarm 60 could be built with other technologies, i.e., loudspeaker. Referring to FIG. 5, it can be understood, from possible combinations of positions in which the switches 28, 32 can be placed as selected by the user, that the warning alarm can be selected to "sound" as either a visual signal solely, as an audible signal solely, or as visual and audible signals concurrently.

Figure 7:
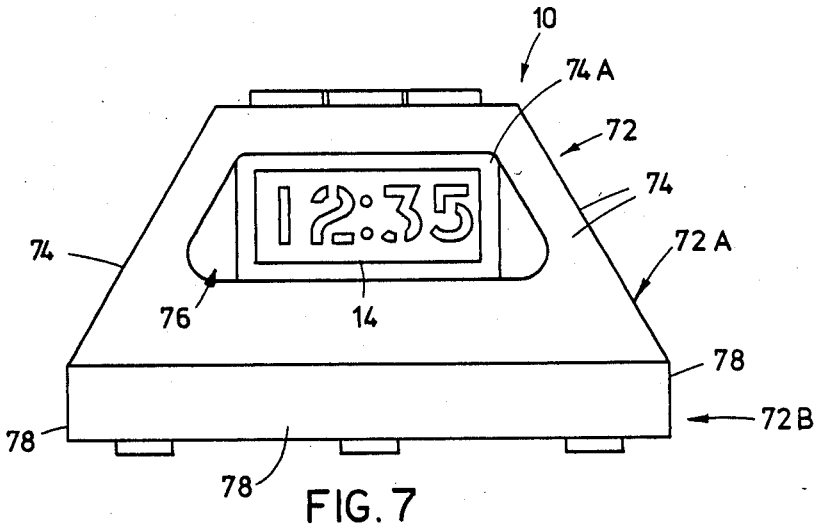
FIG. 7 is a side elevational view of another embodiment of the clock and timer unit of the present invention.
Figure 8:
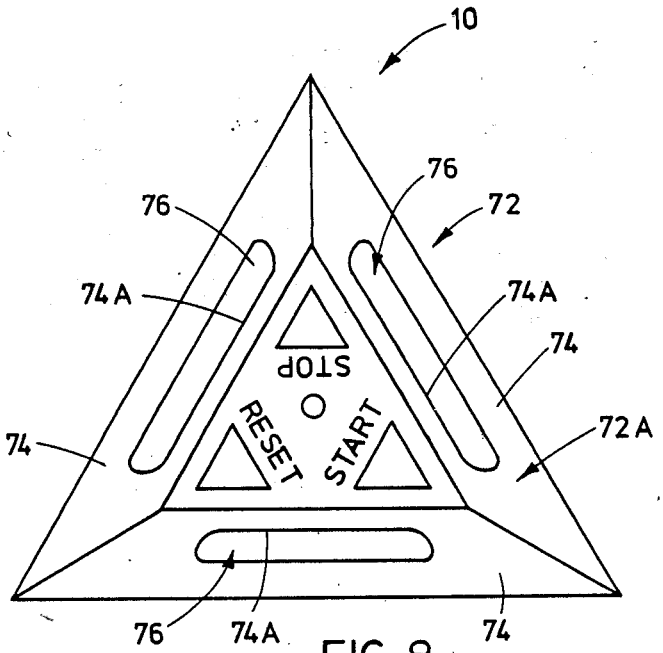
FIG. 8 is a top plan view of the dual mode unit of FIG. 7.

A slightly modified embodiment of the housing, designated 72, is seen in FIGS. 7 and 8. It will be observed that in the one embodiment of the housing 12 shown in FIGS. 1–4, the displays 14 are mounted in inclined orientations by the inclined side surfaces 22. In the modified embodiment of FIGS. 7 and 8, the inclined side surfaces 74 of the upper display support portion 72A of the housing 72 have recesses 76 which define generally vertical surface portions 74A on which are supported the displays 14 in vertical orientations. Also, it will be noted that the side surfaces 78 of the lower skirt portion 72B of the housing 72 in FIGS. 7 and 8 are generally vertical rectangular-shaped planar side surfaces. Further, the side surfaces 74, 78 are each respectively interconnected with one another at their opposite side edges to defined sharp instead of rounded corners.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

Having thus described the invention, what is claimed is:

1. A dual mode clock and timer unit, comprising:

(a) a housing having a generally truncated pyramidal shape;

(b) a plurality of displays mounted in angularly displaced relationship from one another on said housing for facilitating the viewing of time-related data from different directions;

(c) a plurality of switches mounted on said housing and being actuatable for selecting one or the other of dual clock and timer operating modes and, after one or the other of said dual modes have been selected, for causing different functions to occur in one of said modes than in the other of said modes; and (d) circuit means electrically coupled between said switches and each of said displays for concurrently carrying out operations in clock and timer modes and for causing indication of time-related data on said displays relating to one or the other, but not both concurrently, of clock and timer modes in response to selected actuation of said switches.

2. The unit as recited in claim 1, wherein said housing has a top, a bottom and a plurality of sides located between said top and bottom, all of said top, bottom and sides together defining the exterior of said housing in the generally truncated pyramidal shape.

3. The unit as recited in claim 2, wherein each display is mounted on one of said sides of said housing.

4. The unit as recited in claim 2, wherein said housing top and bottom are oriented in generally horizontal planes and vertically spaced from one another.

5. The unit as recited in claim 2, wherein said sides are interconnected to one another and angularly displaced from one another.

6. The unit as recited in claim 2, wherein said top has the same geometric shape as said bottom but is smaller in area than said bottom.

7. The unit as recited in claim 2, wherein said sides each have substantially the same geometric shape and the same area.

8. The unit as recited in claim 2, wherein each of said sides has a portion mounting one of said displays in an inclined orientation.

9. The unit as recited in claim 2, wherein said switches include start, stop and reset switches mounted on said top of said housing and being actuatable for causing said circuit means to perform different functions when said timer mode has been selected.

10. The unit as recited in claim 2, wherein said switches include a count up/down switch mounted on said bottom of said housing and being actuatable to one or the other of a pair of positions for causing said circuit means to respectively perform one or the other of count upward from zero to a desired count or countdown toward zero to a desired count when said timer operating mode has been selected.

11. The unit as recited in claim 10, wherein said count up/down switch in either one or the other of said positions is also for causing said circuit means to continue to count upward or downward after reaching the desired count.

12. The unit as recited in claim 2, wherein said switches include a mode selection switch mounted on said bottom of said housing and being actuatable to one or the other of a pair of positions for causing said circuit means to respectively select one or the other of said clock and timer operating modes.

13. The unit as recited in claim 2, wherein:

said unit further comprises a warning alarm; and said switches include alarm selecting switches being actuatable to several different combinations of positions for selecting said warning alarm to sound as either a visual signal solely, as an audible signal solely, or as visual and audible signals concurrently.

14. The unit as recited in claim 2, wherein:

said unit further comprises an alarm being preset to sound in several different ways depending on the relationship of the current time to a desired time; and said circuit means is operable to sound said alarm a first predetermined number of times at a preselected period of time before the desired time is reached, to sound said alarm a second predetermined number of times when the desired time is reached, and to recurringly sound said alarm said second predetermined number of times at lapse of preset time intervals after the desired time, said second predetermined number of times said alarm is sounded being greater than the first predetermined number of times.

15. A dual mode clock and timer unit, comprising:

(a) a housing having a top surface, a bottom surface and a plurality of side surfaces located between said top and bottom surfaces, all of said surfaces together defining the exterior of said housing in a generally triangular truncated pyramidal shape;

(b) a plurality of displays, each display mounted on one of said side surfaces of said housing for facilitating the viewing of time-related data from different directions;

(c) a plurality of switches mounted on top and bottom surfaces of said housing, at least one of said switches being actuatable for selecting one or the other of clock and timer operating modes, at least some of said switches being actuatable, after one or the other of said modes have been selected, for causing different functions to occur in one of said modes than in the other of said modes; and (d) circuit means mounted on said housing and electrically interconnected between said switches and each of said displays for concurrently carrying out operations in clock and timer modes and for causing indication of time-related data on said displays relating to one or the other, but not both concurrently, of clock and timer modes in response to selected actuation of said switches.

16. The unit as recited in claim 15, wherein said top and bottom surfaces have generally planar horizontal orientations and are vertically spaced from one another.

17. The unit as recited in claim 16, wherein said top surface has the same geometric shape as said bottom surface but is smaller in area than said bottom surface.

18. The unit as recited in claim 15, wherein said side surfaces are interconnected to one another and angularly displaced from one another.

19. The unit as recited in claim 15, wherein each of said side surfaces has a portion mounting one of said displays in an inclined orientation.

20. The unit as recited in claim 15, wherein said switches include start, stop and reset switches mounted on said top of surface of said housing and being actuatable for causing said circuit means to perform different functions when said timer mode has been selected.

21. The unit as recited in claim 15, wherein said switches include a count up/down switch mounted on said bottom of said housing and being actuatable to one or the other of a pair of positions for causing said circuit means to respectively perform one or the other of count upward from zero to a desired count or countdown toward zero to a desired count when said timer operating mode has been selected.

22. The unit as recited in claim 21, wherein said count up/down switch in either one or the other of said positions is also for causing said circuit means to continue to count upward or downward after reaching the desired count.

23. The unit as recited in claim 15, wherein said switches include a mode selection switch mounted on said bottom of said housing and being actuatable to one or the other of a pair of positions for causing said circuit means to respectively select one or the other of said clock and timer operating modes.

24. The unit as recited in claim 15, wherein said switches include alarm selecting switches being actuatable to several different combinations of positions for selecting a warning alarm to sound as either a visual signal solely, as an audible signal solely, or as visual and audible signals concurrently.

25. The unit as recited in claim 15, wherein:

said unit further comprises an alarm being preset to sound in several different ways depending on the relationship of the current time to a desired time; and said circuit means is operable to sound said alarm a first predetermined number of times at a preselected period of time before the desired time is reached, to sound said alarm a second predetermined number of times when the desired time is reached, and to recurringly sound said alarm said second predetermined number of times at lapse of preset time intervals after the desired time, said second predetermined number of times said alarm is sounded being greater than the first predetermined number of times.

26. A dual mode clock and timer unit, comprising:

(a) a housing having generally vertically-spaced and horizontally-extending planar top and bottom end surfaces and a plurality of side surfaces disposed between said top and bottom end surfaces and angularly displaced from one another, said top surface having the same geometric shape as said bottom surface but being smaller in area than said bottom surface, said side surfaces each having the same geometric shape and area, as one another, said surfaces defining the exterior of said housing in a generally triangular truncated pyramidal shape;

(b) a plurality of means for displaying time-related data, each displaying means being mounted on one of said side surfaces of said housing for facilitating the viewing of time-related data from different directions;

(c) a plurality of switches mounted on said top and bottom surfaces of said housing, at least one of said switches being actuatable for selecting one or the other of dual clock and timer operating modes of said unit, at least some of said switches being actuatable, after one or the other of said dual modes have been selected, for causing different functions to occur in one of said modes than in the other of said modes; and (d) circuit means mounted on said housing and electrically interconnected between said switches and each of said displays for concurrently carrying out operations in clock and timer modes and for causing indication of time-related data on said displays relating to one or the other, but not both concurrently, of clock and timer modes in response to selected actuation of said switches;

(e) said switches including start, stop and reset switches mounted on said top of surface of said housing and being actuatable for causing said circuit means to perform different functions when said timer mode has been selected;

(f) said switches also including a mode selection switch mounted on said bottom surface of said housing and being actuatable for causing said circuit means to respectively select one or the other of said clock and timer operating modes.

27. The unit as recited in claim 26, wherein each of said side surfaces has a portion mounting one of said displaying means in an inclined orientation.

28. The unit as recited in claim 26, wherein said switches further include a count up/down switch mounted on said bottom surface of said housing and being actuatable for causing said circuit means to respectively perform one or the other of count upward from zero to a desired count or countdown toward zero to a desired count when said timer operating mode has been selected.

29. The unit as recited in claim 28, wherein:

said unit further comprises an alarm being preset to sound in several different ways depending on the relationship of the current time to a desired time;

said switches include alarm selecting switches being actuatable to several different combinations of positions for selecting said alarm to sound as either a visual signal solely, as an audible signal solely, or as visual and audible signals concurrently; and said circuit means is operable to sound said alarm a first predetermined number of times at a preselected period of time before the desired time is reached, to sound said alarm a second predetermined number of times when the desired time is reached, and to recurringly sound said alarm said second predetermined number of times at lapse of preset time intervals after the desired time, said second predetermined number of times said alarm is sounded being greater than the first predetermined number of times.

30. The unit as recited in claim 29, wherein said circuit means is operable to retain a desired count previously selected in said timer operating mode.

* * * * *